US007792466B2

(12) United States Patent
Nakayama et al.

(10) Patent No.: US 7,792,466 B2
(45) Date of Patent: Sep. 7, 2010

(54) IMAGE FORMING APPARATUS AND DEVELOPING DEVICE

(75) Inventors: Masayoshi Nakayama, Minato-ku (JP); Yoshitaka Fujinuma, Minato-ku (JP); Takashi Suzuki, Minato-ku (JP); Susumu Tateyama, Minato-ku (JP); Tsutomu Nakagawa, Minato-ku (JP); Tatsuya Kubo, Minato-ku (JP)

(73) Assignee: Ricoh Company, Ltd., Tokyo (JP)

( * ) Notice: Subject to any disclaimer, the term of this patent is extended or adjusted under 35 U.S.C. 154(b) by 189 days.

(21) Appl. No.: 11/754,695

(22) Filed: May 29, 2007

(65) Prior Publication Data

US 2007/0274742 A1 Nov. 29, 2007

(30) Foreign Application Priority Data

May 29, 2006 (JP) ..... 2006-148112

(51) Int. Cl.
*G03G 15/08* (2006.01)

(52) U.S. Cl. ..... 399/256; 399/254

(58) Field of Classification Search ..... 399/252–256, 399/259, 281, 119, 257, 258
See application file for complete search history.

(56) References Cited

U.S. PATENT DOCUMENTS

| | | | | |
|---|---|---|---|---|
| 5,682,583 | A * | 10/1997 | Ito et al. | 399/254 |
| 5,842,090 | A * | 11/1998 | Mikawa | 399/256 |
| 6,281,961 | B1 * | 8/2001 | Sako et al. | 355/27 |
| 2005/0031381 | A1 * | 2/2005 | Arimoto | 399/258 |

FOREIGN PATENT DOCUMENTS

| | | |
|---|---|---|
| JP | 2001-249545 | 9/2001 |
| JP | 2003-263012 | 9/2003 |

OTHER PUBLICATIONS

U.S. Appl. No. 11/493,856.*
U.S. Appl. No. 12/027,636.*
U.S. Appl. No. 12/031,141.*
U.S. Appl. No. 12/196,604.*
U.S. Appl. No. 12/042,848.*
U.S. Appl. No. 12/059,392.*
U.S. Appl. No. 12/251,580.*
U.S. Appl. No. 12/042,848, filed Mar. 5, 2008, Kita, et al.
U.S. Appl. No. 12/059,392, filed Mar. 31, 2008, Tateyama, et al.
U.S. Appl. No. 12/251,580, filed Oct. 15, 2008, Nakayama et al.

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

In a developing device, a receive-convey screw conveys a developer received from a developer carrier. The receive-convey screw includes a receive-convey blade including a lower, outer circumferential end located in a downstream end of the receive-convey blade in the developer conveyance direction of the receive-convey screw. A slant-convey screw is disposed obliquely relative to an axial direction of the receive-convey screw, and conveys the developer received from the receive-convey screw upward. The slant-convey screw includes a slant-convey blade including a lower, outer circumferential end located in an upstream end of the slant-convey blade in the developer conveyance direction of the slant-convey screw, the lower, outer circumferential end being located at a height level lower than the lower, outer circumferential end of the receive-convey blade.

16 Claims, 10 Drawing Sheets

IMAGE FORMING APPARATUS AND DEVELOPING DEVICE

CROSS-REFERENCE TO RELATED APPLICATION

The present application is based on and claims priority to Japanese patent application No. 2006-148112 filed on May 29, 2006 in the Japan Patent Office, the entire contents of which are hereby incorporated herein by reference.

BACKGROUND OF THE INVENTION

1. Field of the Invention

Exemplary aspects of the present invention relate to an image forming apparatus and a developing device. One particular aspect of the invention relates to an image forming apparatus and a developing device for developing a latent image with a developer.

2. Description of the Related Art

A related art image forming apparatus, such as a copying machine, a facsimile machine, a printer, or a multifunction printer having copying, printing, scanning, and facsimile functions, forms a toner image on a recording medium (e.g., a sheet) according to image data by an electrophotographic method. For example, a charger charges a surface of a photoconductor serving as a latent image carrier. An optical writer emits a light beam onto the charged surface of the photoconductor to form an electrostatic latent image on the photoconductor according to image data. A developing device develops the electrostatic latent image with a developer containing toner particles and magnetic carriers to form a toner image on the photoconductor. The toner image is transferred from the photoconductor onto an intermediate transfer member and is further transferred from the intermediate transfer member onto a sheet. A fixing device applies heat and pressure to the sheet bearing the toner image to fix the toner image on the sheet. Thus, the toner image is formed on the sheet.

One example of the developing device includes a developer carrier, a supply-convey screw opposing the developer carrier, and a convey screw. The supply-convey screw supplies a developer to a whole area in a longitudinal direction of the developer carrier, while the supply-convey screw conveys the developer along its axial direction. While supplying the developer to the developer carrier, the supply-convey screw collects a developer used for developing an electrostatic latent image from the developer carrier. The supply-convey screw conveys the collected developer to its downstream end in a developer conveyance direction of the supply-convey screw. At the downstream end, the developer is delivered from the supply-convey screw to an upstream end of the convey screw in a developer conveyance direction of the convey screw. While the convey screw conveys the developer to its downstream end in the developer conveyance direction of the convey screw, the developer is mixed with a replenishing developer and is delivered to an upstream end of the supply-convey screw in the developer conveyance direction of the supply-convey screw. In the above-described circulation of the developer, while the supply-convey screw collects a developer having a decreased toner density due to development from the developer carrier, the supply-convey screw supplies a developer replenished with toner particles and thereby having a recovered toner density to the developer carrier.

However, the developer conveyed on the supply-convey screw has various toner densities. For example, the developer carried on the upstream end of the supply-convey screw in the developer conveyance direction of the supply-convey screw contains more replenishing toner particles than the developer carried on the downstream end of the supply-convey screw in the developer conveyance direction of the supply-convey screw. On the contrary, the developer carried on the downstream end of the supply-convey screw in the developer conveyance direction of the supply-convey screw contains more developer collected from the developer carrier after being used for development than the developer carried on the upstream end of the supply-convey screw in the developer conveyance direction of the supply-convey screw. Namely, the developer carried on the downstream end of the supply-convey screw in the developer conveyance direction of the supply-convey screw has a lower toner density than the developer carried on the upstream end of the supply-convey screw in the developer conveyance direction of the supply-convey screw.

Another example of a developing device includes a screw for collecting a developer from a developer carrier and another screw for supplying a developer to the developer carrier. For example, the developing device includes a supply-convey screw, a receive-convey screw, and a slant-convey screw. The supply-convey screw supplies a developer to the developer carrier. The receive-convey screw is disposed immediately under the supply-convey screw. The slant-convey screw extends obliquely relative to a horizontal direction in which the supply-convey screw and the receive-convey screw extend. The receive-convey screw receives a developer used for developing an electrostatic latent image from the developer carrier, adds toner particles to the developer so that the developer has a recovered toner density, and sends the developer to the slant-convey screw. The slant-convey screw receives the developer sent from the receive-convey screw and conveys the developer up to the supply-convey screw disposed directly above the receive-convey screw.

A downstream end of the receive-convey screw in a developer conveyance direction of the receive-convey screw extending in the horizontal direction is located at a height level substantially common to an upstream end of the slant-convey screw in a developer conveyance direction of the slant-convey screw extending obliquely relative to the horizontal direction. Namely, the slant-convey screw extends upward from its upstream end to its downstream end in its developer conveyance direction. The developer is delivered against gravity from the receive-convey screw to the slant-convey screw via an opening provided in a wall disposed between the receive-convey screw and the slant-convey screw. Specifically, the downstream end of the receive-convey screw in the developer conveyance direction of the receive-convey screw opposes the upstream end of the slant-convey screw in the developer conveyance direction of the slant-convey screw via the opening. Since the slant-convey screw is obliquely disposed relative to the receive-convey screw, a part near the upstream end of the slant-convey screw in the developer conveyance direction of the slant-convey screw, which faces the receive-convey screw via the opening, is located at a height level higher than the receive-convey screw. Therefore, a developer is delivered against gravity from the receive-convey screw to the slant-convey screw via the opening. As a result, the slant-convey screw may not easily pick up the developer and thereby the developer may be sent back to the receive-convey screw. The sent-back developer may be accumulated on the receive-convey screw. The accumulated developer may push a developer collected from the developer carrier back onto the developer carrier, resulting in formation of a toner image having various toner densities.

BRIEF SUMMARY OF THE INVENTION

This specification describes below an image forming apparatus according to one or more exemplary embodiments of the present invention. In one exemplary embodiment of the present invention, the image forming apparatus includes a latent image carrier and a developing device. The latent image carrier is configured to carry a latent image. The developing device is configured to develop the latent image carried by the latent image carrier with a developer containing toner particles and carriers. The developing device includes a developer carrier, a receive-convey screw, and a slant-convey screw. The developer carrier is configured to carry the developer. The receive-convey screw is configured to receive the developer from the developer carrier and to convey the developer in an axial direction of the receive-convey screw. The receive-convey screw includes a receive-convey blade including a lower, outer circumferential end located in a downstream end of the receive-convey blade in the developer conveyance direction of the receive-convey screw. The slant-convey screw is disposed obliquely relative to the axial direction of the receive-convey screw. The slant-convey screw is configured to receive the developer from the receive-convey screw and to convey the developer upward in an axial direction of the slant-convey screw. The slant-convey screw includes a slant-convey blade including a lower, outer circumferential end located in an upstream end of the slant-convey blade in the developer conveyance direction of the slant-convey screw, the lower, outer circumferential end being located at a height level lower than the lower, outer circumferential end of the receive-convey blade.

This specification further describes below a developing device for developing a latent image carried by a latent image carrier with a developer containing toner particles and carriers according to an exemplary embodiment of the present invention. In one or more exemplary embodiments of the present invention, the developing device includes a developer carrier, a receive-convey screw, and a slant-convey screw. The developer carrier is configured to carry the developer. The receive-convey screw is configured to receive the developer from the developer carrier and to convey the developer in an axial direction of the receive-convey screw. The receive-convey screw includes a receive-convey blade including a lower, outer circumferential end located in a downstream end of the receive-convey blade in the developer conveyance direction of the receive-convey screw. The slant-convey screw is disposed obliquely relative to the axial direction of the receive-convey screw. The slant-convey screw is configured to receive the developer from the receive-convey screw and to convey the developer upward in an axial direction of the slant-convey screw. The slant-convey screw includes a slant-convey blade including a lower, outer circumferential end located in an upstream end of the slant-convey blade in the developer conveyance direction of the slant-convey screw, the lower, outer circumferential end being located at a height level lower than the lower, outer circumferential end of the receive-convey blade.

BRIEF DESCRIPTION OF THE DRAWINGS

A more complete appreciation of the embodiments of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
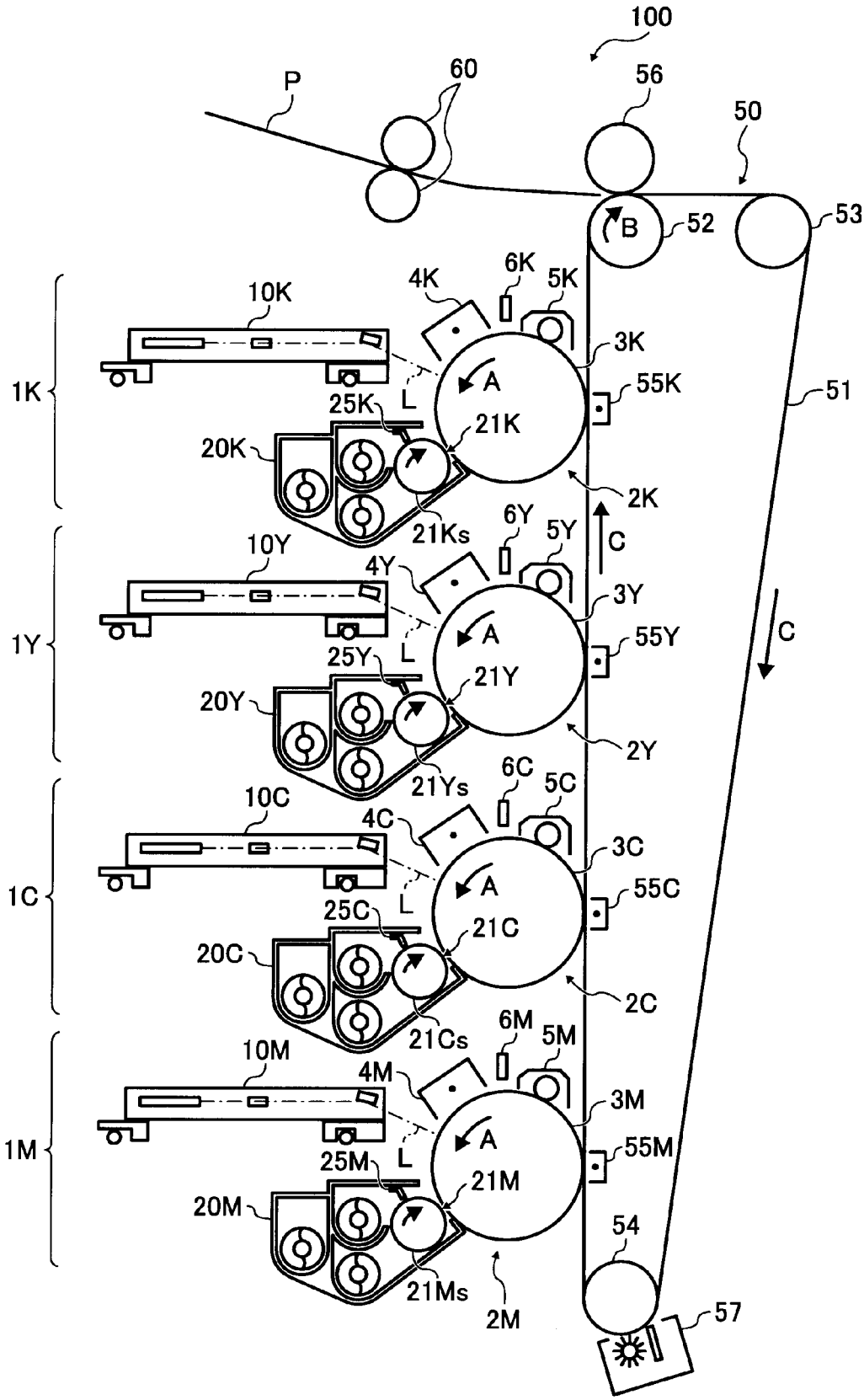
FIG. 1 is a schematic view of an image forming apparatus according to one or more exemplary embodiments of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to one or more exemplary embodiments of the present invention is explained.

As illustrated in FIG. 1, the image forming apparatus 100 includes image forming devices 1M, 1C, 1Y, and 1K and a transfer unit 50. The image forming devices 1M, 1C, 1Y, and 1K include process units 2M, 2C, 2Y, and 2K, optical writers 10M, 10C, 10Y, and 10K, and developing devices 20M, 20C, 20Y, and 20K, respectively. The process units 2M, 2C, 2Y, and 2K include photoconductors 3M, 3C, 3Y, and 3K, chargers 4M, 4C, 4Y, and 4K, cleaners 5M, 5C, 5Y, and 5K, and dischargers 6M, 6C, 6Y, and 6K, respectively. The developing devices 20M, 20C, 20Y, and 20K include developing rollers 21M, 21C, 21Y, and 21K and developing doctor blades 25M, 25C, 25Y, and 25K, respectively. The developing rollers 21M, 21C, 21Y, and 21K include developing sleeves 21Ms, 21Cs, 21Ys, and 21Ks, respectively. The transfer unit 50 includes an intermediate transfer belt 51, a driving roller 52, a tension roller 53, a driven roller 54, transfer chargers 55M, 55C, 55Y, and 55K, a transfer bias roller 56, a registration roller pair 60, and a belt cleaner 57.

The image forming apparatus 100 can be a copying machine, a facsimile machine, a printer, a multifunction printer having copying, printing, scanning, and facsimile functions, or the like. According to this non-limiting exemplary embodiment of the present invention, the image forming apparatus 100 functions as a color printer for printing a color image on a recording medium by an electrophotographic method.

The image forming devices 1M, 1C, 1Y, and 1K are arranged to oppose each other in a vertical direction, and form toner images in magenta, cyan, yellow, and black colors, respectively. The transfer unit 50 is provided beside the image forming devices 1M, 1C, 1Y, and 1K.

The image forming devices 1M, 1C, 1Y, and 1K use toners in colors different from each other (i.e., magenta, cyan, yellow, and black toners) to form toner images in colors different from each other (i.e., magenta, cyan, yellow, and black toner images), respectively, however, the image forming devices 1M, 1C, 1Y, and 1K have a common structure. Therefore, the following describes a structure of the image forming device 1M, which is common to the image forming devices 1C, 1Y, and 1K.

The process unit 2M is attachable to and detachable from the image forming apparatus 100, and includes the photoconductor 3M, the charger 4M, the cleaner 5M, and the discharger GM. The charger 4M, the cleaner 5M, and the discharger GM are provided around the photoconductor 3M. A casing (not shown) supports the photoconductor 3M, the charger 4M, the cleaner 5M, and the discharger GM. Thus, when the process unit 2M is attached to or detached from the image forming apparatus 100, the photoconductor 3M, the charger 4M, the cleaner 5M, and the discharger GM are attached to or detached from the image forming apparatus 100 together.

The photoconductor 3M has a drum shape and rotates in a rotating direction A. The photoconductor 3M includes a pipe (not shown) including aluminum and an organic photosensitive layer (not shown) covering the pipe. The charger 4M uniformly charges a surface of the rotating photoconductor 3M by corona charging with a negative polarity, for example.

The optical writer 10M includes a light source (not shown), such as a laser diode, a polygon mirror (not shown) having a polygonal shape, a polygon motor (not shown) for driving the polygon mirror, an fθ lens (not shown), a lens (not shown), and a reflecting mirror (not shown). The light source emits a laser beam L toward the polygon mirror according to image data sent from a personal computer (not shown), for example. The polygon mirror rotated by the polygon motor deflects and scans the laser beam L onto the surface of the photoconductor 3M via the fθ lens, the lens, and the reflecting mirror. The laser beam L scanned on the surface of the photoconductor 3M forms an electrostatic latent image on the surface of the photoconductor 3M.

The developing device 20M develops the electrostatic latent image formed on the surface of the photoconductor 3M with a magenta toner. For example, the developing device 20M includes a casing (not shown), the developing roller 21M, three convey screws (not shown), and the developing doctor blade 25M. An opening (not shown) provided in the casing exposes a part of an outer circumferential surface of the developing roller 21M. The developing roller 21M includes the developing sleeve 21Ms and a magnetic roller (not shown). The developing sleeve 21Ms serves as a developer carrier for carrying a developer and includes a non-magnetic pipe (not shown) rotated by a driver (not shown). The magnetic roller is provided inside the developing sleeve 21Ms in a manner that the magnetic roller is not driven by the developing sleeve 21Ms. The developing device 20M includes a magenta developer containing magnetic carriers and magenta toner particles having a negative polarity. The three convey screws agitate and convey the magenta developer while charging the magenta toner particles by friction. A magnetic force of the magnetic roller causes the magenta toner particles to be attracted onto a surface of the rotating developing sleeve 21Ms. The rotating developing sleeve 21Ms conveys the attracted magenta toner particles to an opposing position at which the developing sleeve 21Ms opposes the developing doctor blade 25M. At the opposing position, the developing doctor blade 25M regulates a layer thickness of the magenta toner particles on the developing sleeve 21Ms. The rotating developing sleeve 21Ms further conveys the regulated magenta toner particles to a developing position at which the developing sleeve 21Ms opposes the photoconductor 3M.

A power source (not shown) applies a developing bias having a negative polarity to the developing sleeve 21Ms. At the developing position, a developing potential is applied between the developing sleeve 21Ms and the electrostatic latent image formed on the photoconductor 3M so as to electrostatically move the magenta toner particles having a negative polarity from the developing sleeve 21Ms to the electrostatic latent image. A non-developing potential is applied between the developing sleeve 21Ms and a uniformly charged portion on the photoconductor 3M so as to electrostatically move the magenta toner particles having a negative polarity from the uniformly charged portion on the photoconductor 3M to the developing sleeve 21Ms. Namely, the developing potential separates the magenta toner particles contained in the magenta developer from the developing sleeve 21Ms and moves the magenta toner particles onto the electrostatic latent image formed on the photoconductor 3M. Thus, the magenta toner particles develop the electrostatic latent image formed on the photoconductor 3M into a magenta toner image. The rotating developing sleeve 21Ms returns the magenta developer, in which the magenta toner particles have been consumed by developing the electrostatic latent image, to inside of the casing.

The developing device 20M further includes a toner density sensor (not shown), such as a permeability sensor, and a collecting container (not shown). The toner density sensor outputs a voltage having a level corresponding to a permeability of a magenta developer contained in the collecting container. The permeability of the magenta developer properly corresponds to a toner density of the magenta developer. Thus, the toner density sensor outputs a voltage having a level corresponding to the toner density. The voltage level is notified to a toner supply controller (not shown). The toner supply controller includes a memory, such as a RAM (random access memory), for storing data including a magenta Vtref (i.e., a target level of a voltage output by the toner density sensor for magenta color) as well as a cyan Vtref, a yellow Vtref, and a black Vtref (i.e., target levels of voltages output by the toner density sensors for cyan, yellow, and black colors installed in the developing devices 20C, 20Y, and 20K, respectively). For the developing device 20M, the toner supply controller compares a level of a voltage output by the toner density sensor for magenta color with the magenta Vtref, and drives a magenta toner supplier (not shown) for a time period based on a comparison result. Thus, the magenta toner supplier supplies magenta toner particles to the collecting container of the developing device 20M. As described above with respect to one or more embodiments of the invention, when the toner supply controller controls driving of the magenta toner supplier, magenta toner particles in a proper amount are supplied into the magenta developer in which the toner density of the magenta toner particles has decreased after developing the electrostatic latent image formed on the photoconductor 3M. Thus, the toner density of the magenta toner particles contained in the magenta developer in the developing device 20M is maintained in a predetermined range. Similarly, supply of cyan, yellow, and black toner particles is controlled in the developing devices 20C, 20Y, and 20K, respectively.

In the image forming devices 1C, 1Y, and 1K, cyan, yellow, and black toner images are formed on surfaces of the photoconductors 3C, 3Y, and 3K, respectively, through processes common to the image forming device 1M.

According to one or more embodiments of the invention, the transfer unit 50 transfers the magenta, cyan, yellow, and black toner images formed on the photoconductors 3M, 3C, 3Y, and 3K, respectively, onto a recording medium (e.g., a sheet). In the transfer unit 50, the intermediate transfer belt 51, having an endless belt shape, forms a loop inside which the driving roller 52, the tension roller 53, and the driven roller 54 are disposed. Namely, the intermediate transfer belt 51 is looped over the driving roller 52, the tension roller 53, and the driven roller 54. The driving roller 52 rotates in a rotating direction B to rotate the intermediate transfer belt 51 in a rotating direction C. The photoconductors 3M, 3C, 3Y, and 3K contact an outer circumferential surface of the intermediate transfer belt 51 to form first transfer nips, respectively.

In addition to the driving roller 52, the tension roller 53, and the driven roller 54, the four transfer chargers 55M, 55C, 55Y, and 55K are disposed inside the loop of the intermediate transfer belt 51. The transfer chargers 55M, 55C, 55Y, and 55K apply electric charges to an inner circumferential surface of the intermediate transfer belt 51 at positions opposing the first transfer nips, respectively. The applied electric charges form first transfer electric fields for electrically moving toner particles from the photoconductors 3M, 3C, 3Y, and 3K to the outer circumferential surface of the intermediate transfer belt 51 in the first transfer nips, respectively. According to this non-limiting exemplary embodiment, the transfer chargers 55M, 55C, 55Y, and 55K apply electric charges by a corona charge method. However, transfer rollers for applying transfer biases may be used instead of the transfer chargers 55M, 55C, 55Y, and 55K.

The first transfer electric fields formed in the first transfer nips and pressures applied in the first transfer nips move the magenta, cyan, yellow, and black toner images formed on the photoconductors 3M, 3C, 3Y, and 3K, respectively, to the outer circumferential surface of the intermediate transfer belt 51. Namely, the magenta, cyan, yellow, and black toner images are transferred from the photoconductors 3M, 3C, 3Y, and 3K onto the outer circumferential surface of the intermediate transfer belt 51, respectively. Thus, the magenta, cyan, yellow, and black toner images are superimposed on the outer circumferential surface of the intermediate transfer belt 51.

In the image forming device 1M, the cleaner 5M removes magenta toner particles not transferred onto the outer circumferential surface of the intermediate transfer belt 51 and thereby remaining on the surface of the photoconductor 3M. The discharger 6M discharges the surface of the photoconductor 3M. In the image forming devices 1C, 1Y, and 1K, the cleaners 5C, 5Y, and 5K and the dischargers 6C, 6Y, and 6K perform operations common to the cleaner 5M and the discharger 6M, respectively.

The transfer bias roller 56 contacts the outer circumferential surface of the intermediate transfer belt 51 at a position at which the intermediate transfer belt 51 is looped over the driving roller 52, so as to form a second transfer nip. A voltage applier (not shown), such as a light source and a wire, applies a second transfer bias to the transfer bias roller 56. The applied second transfer bias forms a second transfer electric field between the transfer bias roller 56 and the grounded driving roller 52. The rotating intermediate transfer belt 51 causes the magenta, cyan, yellow, and black toner images superimposed on the outer circumferential surface of the intermediate transfer belt 51 to enter the second transfer nip.

A paper tray (not shown) loads a recording medium (e.g., a plurality of sheets P). A feeder (not shown) feeds an uppermost sheet of the sheets P loaded in the paper tray toward a feeding path (not shown) at a proper time. The registration roller pair 60 is disposed on an end of the feeding path in a sheet feeding direction and forms a registration nip. The registration roller pair 60 rotates to nip the sheet P fed by the feeder at the registration nip.

Immediately after the registration roller pair 60 nips a foremost head of the sheet P in the sheet feeding direction, the registration roller pair 60 stops rotating. The registration roller pair 60 starts rotating to feed the sheet P toward the second transfer nip at a proper time when the magenta, cyan, yellow, and black toner images superimposed on the outer circumferential surface of the intermediate transfer belt 51 are transferred on the sheet P. For example, the second transfer electric field formed in the second transfer nip and a pressure applied in the second transfer nip transfer the magenta, cyan, yellow, and black toner images superimposed on the outer circumferential surface of the intermediate transfer belt 51 onto the sheet P, so as to form a color toner image on the sheet P. The sheet P bearing the color toner image is fed out of the second transfer nip to a fixing device (not shown). The fixing device fixes the color toner image on the sheet P.

The belt cleaner 57 opposes the driven roller 54 via the intermediate transfer belt 51. Namely, the belt cleaner 57 and the driven roller 54 nip the intermediate transfer belt 51. The belt cleaner 57 removes toner particles not transferred and thereby remaining on the outer circumferential surface of the intermediate transfer belt 51 after the magenta, cyan, yellow, and black toner images superimposed on the outer circumferential surface of the intermediate transfer belt 51 are transferred onto the sheet P.

Figure 2:
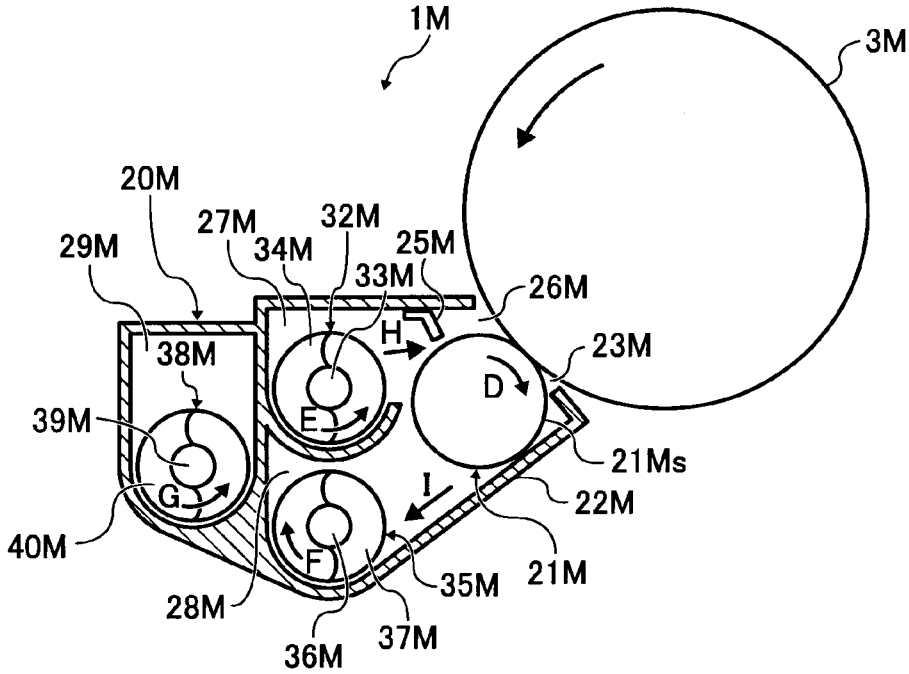
FIG. 2 is a sectional view of an image forming device included in the image forming apparatus shown in FIG. 1.

FIG. 2 is a sectional view of the developing device 20M and the photoconductor 3M according to one or more embodiments of the invention. As illustrated in FIG. 2, the developing device 20M further includes a casing 22M, a developing room 26M, a developer supplying room 27M, a developer collecting room 28M, and a developer returning room 29M. The developing room 26M includes the developing roller 21M and an opening 23M. The developer supplying room 27M includes a supply-convey screw 32M. The developer collecting room 28M includes a receive-convey screw 35M. The developer returning room 29M includes a slant-convey screw 38M. The supply-convey screw 32M includes a supply-convey shaft 33M and a supply-convey blade 34M. The receive-convey screw 35M includes a receive-convey shaft 36M and a receive-convey blade 37M. The slant-convey screw 38M includes a slant-convey shaft 39M and a slant-convey blade 40M.

The casing 22M forms the developing room 26M, the developer supplying room 27M, the developer collecting room 28M, and the developer returning room 29M. The developing room 26M, the developer supplying room 27M, the developer collecting room 28M, and the developer returning room 29M contain a magenta developer.

As described above, the developing roller 21M includes the developing sleeve 21Ms and the magnetic roller. The developing sleeve 21Ms includes a non-magnetic pipe. A driver (not shown) including a motor (not shown) and a driving force transmitter (not shown) rotates the developing sleeve 21Ms in a rotating direction D. The magnetic roller is provided inside the developing sleeve 21Ms in a manner that the magnetic roller is not driven by the developing sleeve 21Ms.

In the developing room 26M, the opening 23M is provided in a wall of the casing 22M, which faces the photoconductor 3M. The opening 23M exposes a part of the outer circumferential surface of the developing sleeve 21Ms. The developer supplying room 27M and the developer collecting room 28M face a side of the developing room 26M opposite to a side of the developing room 26M facing the photoconductor 3M. The developer supplying room 27M and the developer collecting room 28M are connected to the developing room 26M along an axial direction of the developing roller 21M. The developer supplying room 27M is provided above the developer collecting room 28M in a vertical direction. Each of the developer supplying room 27M and the developer collecting room 28M is connected at its side facing the photoconductor 3M (i.e., on the right side in FIG. 2) to the developing room 26M along a longitudinal direction of each of the developer supplying room 27M and the developer collecting room 28M.

The supply-convey screw 32M, like the photoconductor 3M and the developing roller 21M, extends in a horizontal direction. The supply-convey screw 32M includes the supply-convey shaft 33M and the supply-convey blade 34M. The supply-convey shaft 33M has a bar shape. The supply-convey blade 34M is provided on an outer circumferential surface of the supply-convey shaft 33M in a manner that the supply-convey blade 34M has a spiral shape. A driver (not shown) including a motor (not shown) and a driving force transmitter (not shown) rotates the supply-convey shaft 33M and the supply-convey blade 34M in a rotating direction E.

The receive-convey screw 35M, like the photoconductor 3M, the developing roller 21M, and the supply-convey screw 32M, extends in the horizontal direction. The receive-convey screw 35M includes the receive-convey shaft 36M and the receive-convey blade 37M. The receive-convey shaft 36M has a bar shape. The receive-convey blade 37M is provided on an outer circumferential surface of the receive-convey shaft 36M in a manner that the receive-convey blade 37M has a spiral shape. A driver (not shown) rotates the receive-convey shaft 36M and the receive-convey blade 37M in a rotating direction F.

The developer returning room 29M faces a side of the developer supplying room 27M and the developer collecting room 28M opposite to a side of the developer supplying room 27M and the developer collecting room 28M facing the developing room 26M. The developer returning room 29M, unlike the developing room 26M, the developer supplying room 27M, and the developer collecting room 28M, extends in a direction slanted relative to the horizontal direction. The slant-convey blade 40M is provided on an outer circumferential surface of the slant-convey shaft 39M. In the developer returning room 29M, the slant-convey shaft 39M and the slant-convey blade 40M extend in a direction slanted relative to the horizontal direction. A driver (not shown) rotates the slant-convey shaft 39M and the slant-convey blade 40M in a rotating direction G.

Figure 3:
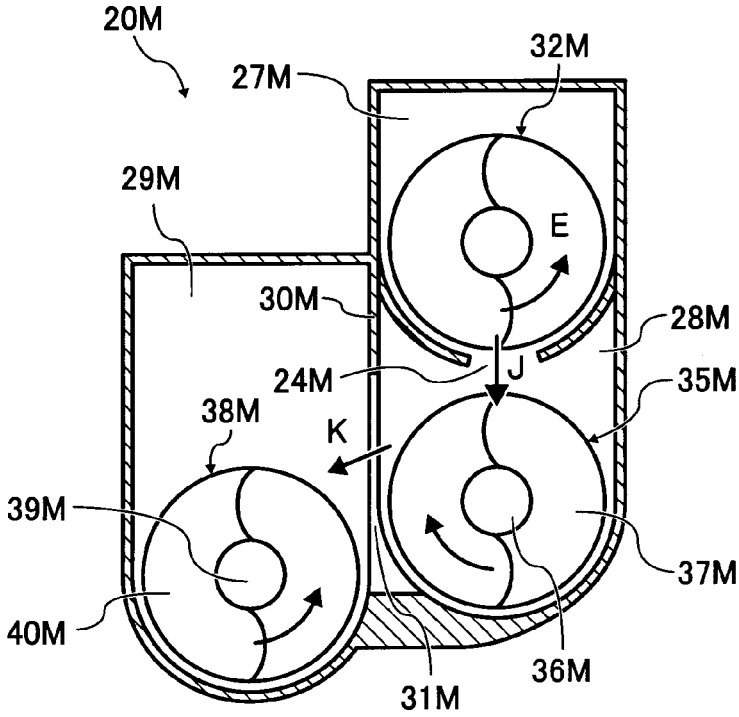
FIG. 3 is a sectional front view of a front portion of a developing device included in the image forming device shown in FIG. 2.

As illustrated in FIG. 3, the developing device 20M further includes a wall 30M, an opening 31M, and a drop opening 24M. The wall 30M separates the developer returning room 29M from the developer supplying room 27M and the developer collecting room 28M. However, the opening 31M provided in the wall 30M connects a part of the developer returning room 29M to the developer supplying room 27M and the developer collecting room 28M.

As illustrated in FIG. 2, in the developer supplying room 27M, the supply-convey screw 32M rotates to convey a magenta developer (not shown) held by the supply-convey blade 34M from one end (i.e., an upstream end of the supply-convey screw 32M in a developer conveyance direction of the supply-convey screw 32M) to another end (i.e., a downstream end of the supply-convey screw 32M in the developer conveyance direction of the supply-convey screw 32M) of a longitudinal direction (i.e., an axial direction) of the supply-convey screw 32M. Accordingly, the magenta developer is conveyed in a direction H toward the developing sleeve 21Ms of the developing roller 21M. A magnetic force of the magnetic roller provided inside the developing sleeve 21Ms attracts the magenta developer onto the developing sleeve 21Ms. As illustrated in FIG. 3, a magenta developer not attracted onto the developing sleeve 21Ms (depicted in FIG. 2) is conveyed to the vicinity of the downstream end of the supply-convey screw 32M in the developer conveyance direction of the supply-convey screw 32M, and drops in a direction J into the developer collecting room 28M through the drop opening 24M provided in a bottom wall of the developer supplying room 27M.

As illustrated in FIG. 2, the rotating developing sleeve 21Ms conveys a magenta developer attracted onto the developing sleeve 21Ms to the developing position at which the magenta developer develops the electrostatic latent image formed on the photoconductor 3M. The rotating developing sleeve 21Ms conveys a magenta developer not consumed for developing to a connecting position at which the developing room 26M is connected to the developer collecting room 28M. A repulsive magnetic field formed by the magnetic roller included in the developing roller 21M separates the magenta developer from the developing sleeve 21Ms. The separated magenta developer drops in a direction I into the developer collecting room 28M.

In the developer collecting room 28M, the receive-convey screw 35M rotates to convey a magenta developer (not shown) held by the receive-convey blade 37M from one end (i.e., an upstream end of the receive-convey screw 35M in a developer conveyance direction of the receive-convey screw 35M) to another end (i.e., a downstream end of the receive-convey screw 35M in the developer conveyance direction of the receive-convey screw 35M) of a longitudinal direction (i.e., an axial direction) of the receive-convey screw 35M. While the receive-convey screw 35M conveys the magenta developer, the toner supplier supplies magenta toner particles to the magenta developer. As illustrated in FIG. 3, the developer collecting room 28M also receives a magenta developer dropping from the developer supplying room 27M through the drop opening 24M. The magenta developer is conveyed to the vicinity of the downstream end of the receive-convey screw 35M in the developer conveyance direction of the receive-convey screw 35M, and enters in a direction K into the developer returning room 29M through the opening 31M provided in the wall 30M.

Figure 4:
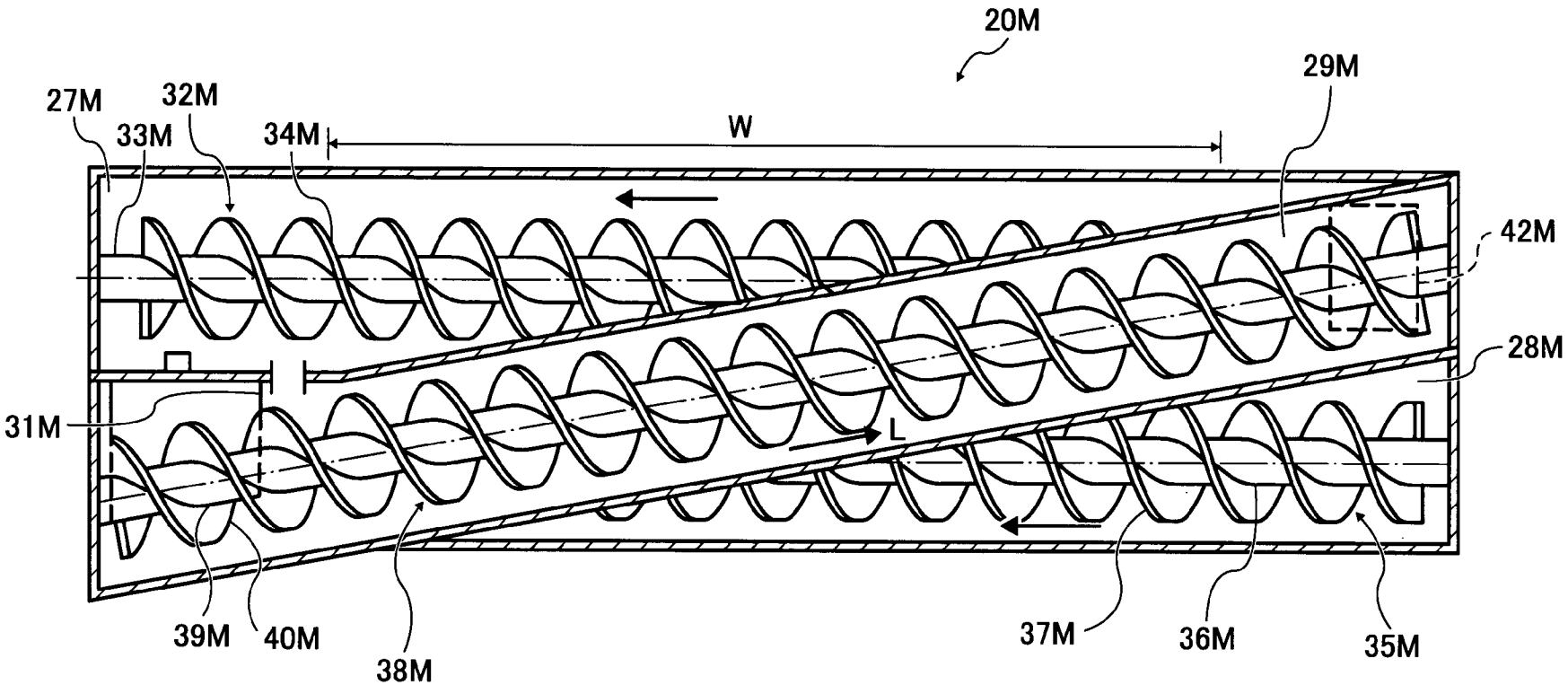
FIG. 4 is a sectional side view of the developing device shown in FIG. 3.
Figure 5:
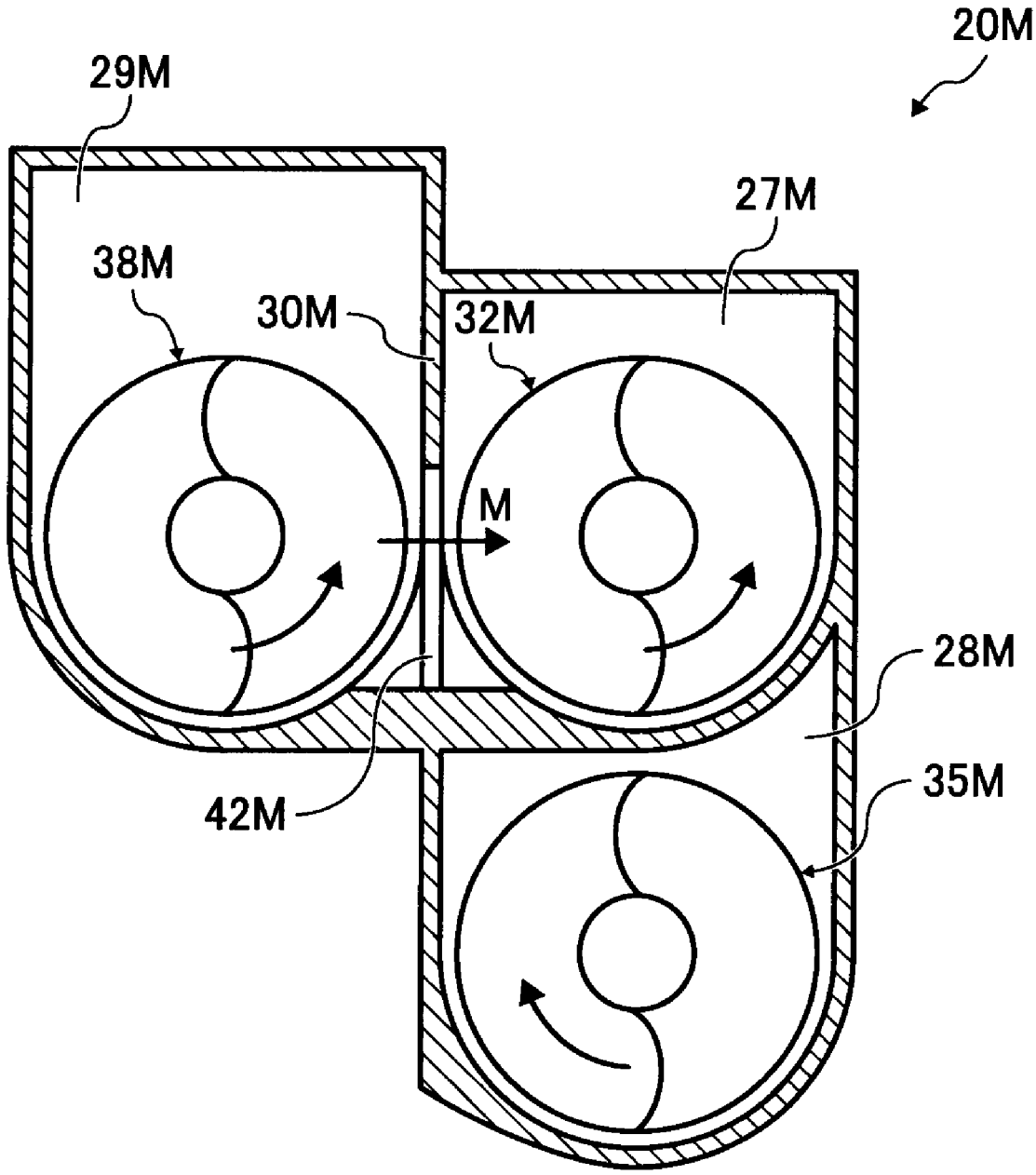
FIG. 5 is a sectional front view of a rear portion of the developing device shown in FIG. 3.

As illustrated in FIGS. 4 and 5, the developing device 20M further includes a return opening 42M. The return opening 42M is provided in the wall 30M.

When the magenta developer enters the developer returning room 29M, the magenta developer is received in an upstream end of the slant-convey screw 38M in a developer conveyance direction of the slant-convey screw 38M. As illustrated in FIG. 4, the slant-convey screw 38M is slanted in a manner that the upstream end of the slant-convey screw 38M in the developer conveyance direction of the slant-convey screw 38M is located at a height level lower than a downstream end of the slant-convey screw 38M in the developer conveyance direction of the slant-convey screw 38M. Therefore, the slant-convey screw 38M rotates to convey the magenta developer upward in a direction L. As illustrated in FIG. 5, when the magenta developer is conveyed to the vicinity of the downstream end of the slant-convey screw 38M in the developer conveyance direction of the slant-convey screw 38M, the magenta developer enters the developer supplying room 27M in a direction M through the return opening 42M. Namely, the magenta developer enters the upstream end of the supply-convey screw 32M in the developer conveyance direction of the supply-convey screw 32M. In FIG. 4, a width W represents a valid image forming area on the photoconductor 3M (depicted in FIG. 2) in an axial direction of the photoconductor 3M.

As illustrated in FIG. 1, according to this non-limiting exemplary embodiment, each of the four photoconductors 3M, 3C, 3Y, and 3K serves as a latent image carrier for carrying a latent image on its surface. Each of the optical writers 10M, 10C, 10Y, and 10K serves as a latent image forming member for forming a latent image on the uniformly charged surface of each of the photoconductors 3M, 3C, 3Y, and 3K. Each of the developing devices 20M, 20C, 20Y, and 20K serves as a developing device for developing a latent image formed on the surface of each of the photoconductors 3M, 3C, 3Y, and 3K.

Figure 6:
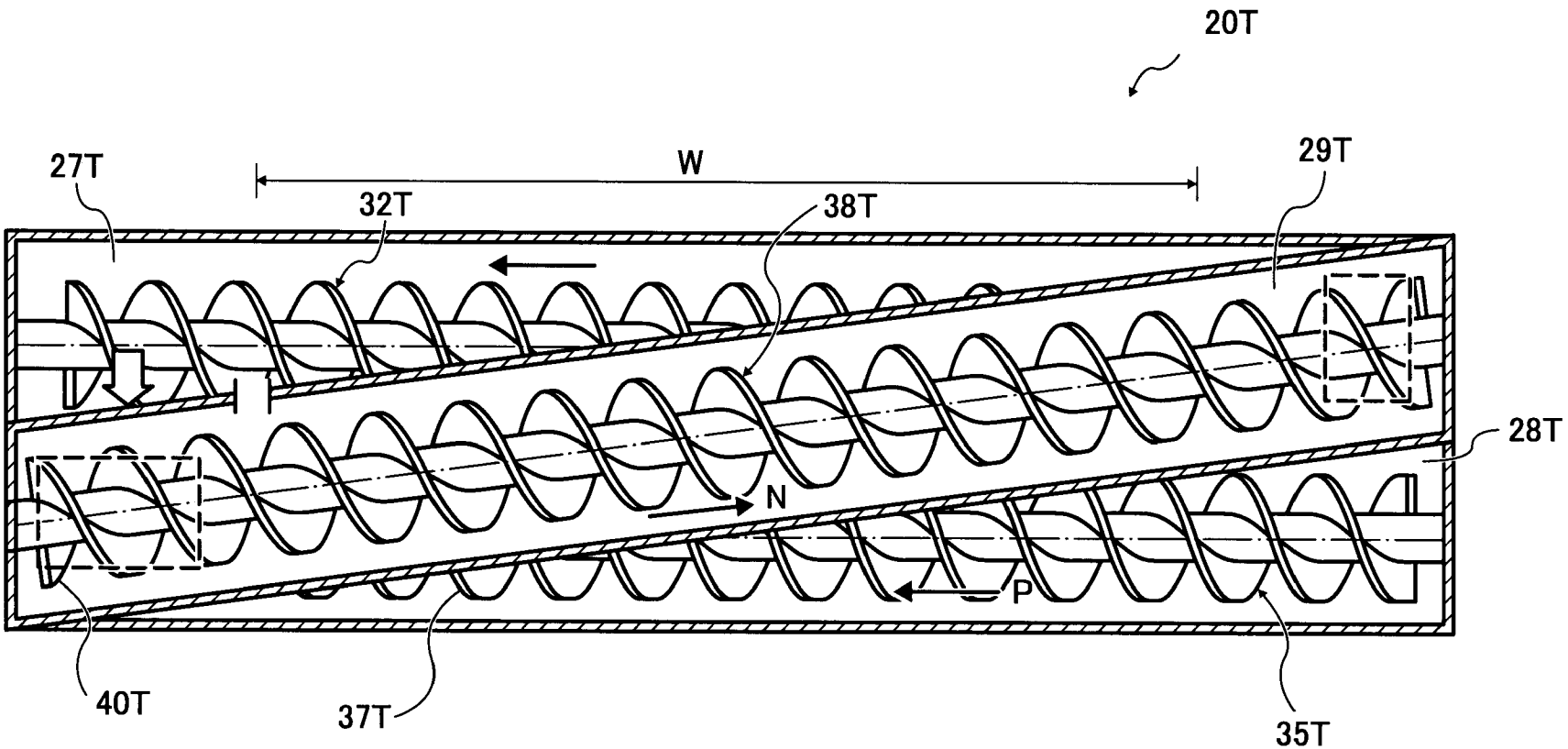
FIG. 6 is a sectional side view of a tester developing device.
Figure 7:
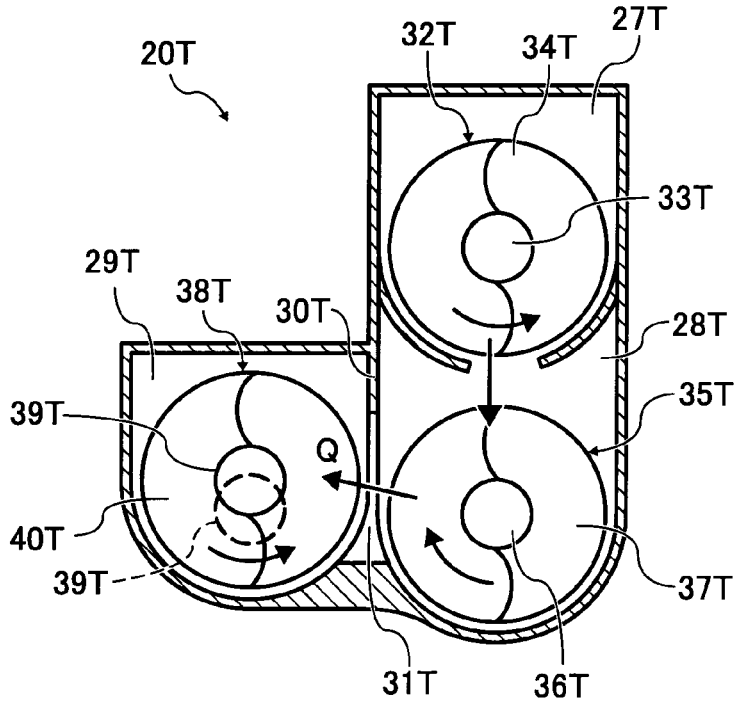
FIG. 7 is a sectional front view of a front portion of the tester developing device shown in FIG. 6.
Figure 8:
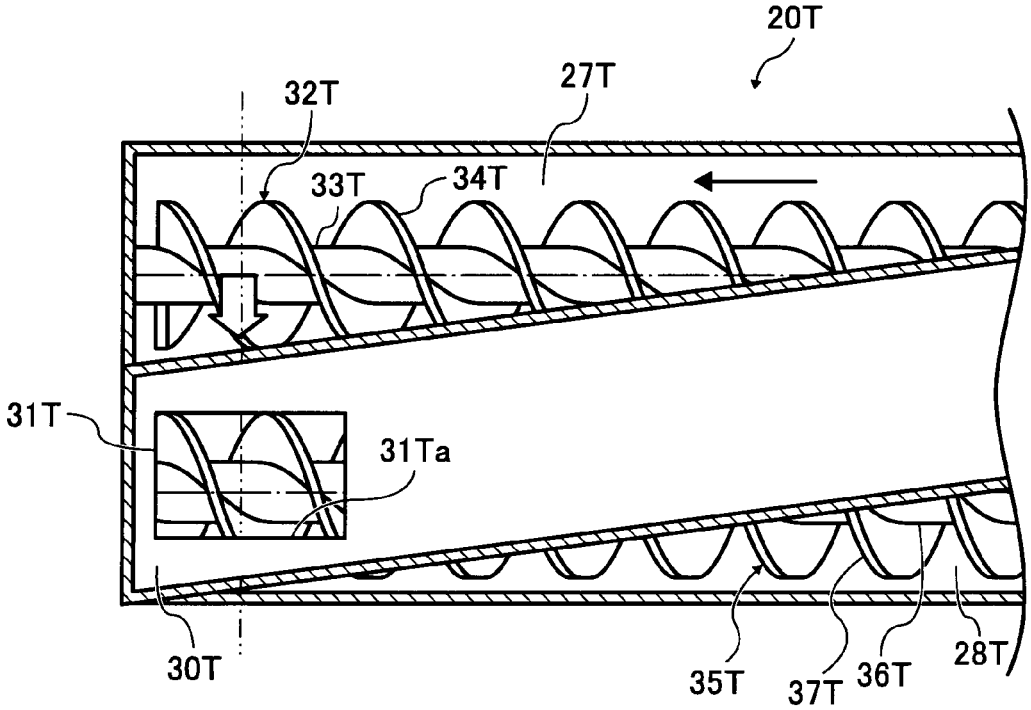
FIG. 8 is an enlarged sectional side view of the tester developing device shown in FIG. 6.

Referring to FIGS. 6 to 8, the following describes a tester developing device 20T according to one or more embodiments of the invention. FIG. 6 is a sectional side view of the tester developing device 20T. As illustrated in FIG. 6, the tester developing device 20T includes a developer supplying room 27T, a developer collecting room 28T, and a developer returning room 29T. The developer supplying room 27T includes a supply-convey screw 32T. The developer collecting room 28T includes a receive-convey screw 35T. The developer returning room 29T includes a slant-convey screw 38T. A width W represents a valid image forming area on a photoconductor (not shown) in an axial direction of the photoconductor.

FIG. 7 is a sectional front view of the tester developing device 20T. As illustrated in FIG. 7, the supply-convey screw 32T includes a supply-convey shaft 33T and a supply-convey blade 34T. The receive-convey screw 35T includes a receive-convey shaft 36T and a receive-convey blade 37T. The slant-convey screw 38T includes a slant-convey shaft 39T and a slant-convey blade 40T.

The receive-convey screw 35T rotates to convey a developer in a direction P from the right in FIG. 6 (i.e., an upstream end of the receive-convey screw 35T or the receive-convey blade 37T in a developer conveyance direction of the receive-convey screw 35T or the receive-convey blade 37T) to the left in FIG. 6 (i.e., a downstream end of the receive-convey screw 35T or the receive-convey blade 37T in the developer conveyance direction of the receive-convey screw 35T or the receive-convey blade 37T). The slant-convey screw 38T rotates to convey a developer in a direction N from the left in FIG. 6 (i.e., an upstream end of the slant-convey screw 38T or the slant-convey blade 40T in a developer conveyance direction of the slant-convey screw 38T or the slant-convey blade 40T) to the right in FIG. 6 (i.e., a downstream end of the slant-convey screw 38T or the slant-convey blade 40T in the developer conveyance direction of the slant-convey screw 38T or the slant-convey blade 40T). In FIG. 6, the downstream end of the receive-convey screw 35T in the developer conveyance direction of the receive-convey screw 35T is behind the upstream end of the slant-convey screw 38T in the developer conveyance direction of the slant-convey screw 38T, and is thereby not illustrated. However, a lower, outer circumferential end of the downstream end of the receive-convey blade 37T (i.e., a leftmost portion of the receive-convey blade 37T in FIG. 6) in the developer conveyance direction of the receive-convey screw 35T is located at a height level common to a lower, outer circumferential end of the upstream end of the slant-convey blade 40T (i.e., a leftmost portion of the slant-convey blade 40T in FIG. 6) in the developer conveyance direction of the slant-convey screw 38T. Namely, only the downstream end of the receive-convey blade 37T in the developer conveyance direction of the receive-convey blade 37T is located at a height level common to the upstream end of the slant-convey blade 40T in the developer conveyance direction of the slant-convey blade 40T. Therefore, the other part of the receive-convey blade 37T is located at a height level lower than the slant-convey blade 40T.

FIG. 7 illustrates a cross section of the developing device 20T taken along a plane provided a bit closer to the upstream end from the downstream end of the receive-convey screw 35T in the developer conveyance direction of the receive-convey screw 35T. As illustrated in FIG. 7, the tester developing device 20T further includes a wall 30T and an opening 31T.

At the downstream end of the receive-convey blade 37T in the developer conveyance direction of the receive-convey blade 37T, the receive-convey screw 35T is located at a height level common to the slant-convey screw 38T. Namely, the slant-convey shaft 39T is disposed at a position illustrated in a broken line. However, at a position a bit closer to the upstream end of the receive-convey blade 37T in the developer conveyance direction of the receive-convey blade 37T (i.e., a position a bit closer to a center in a longitudinal direction of the slant-convey shaft 39T), the slant-convey screw 38T is located at a height level higher than the receive-convey screw 35T.

The wall 30T separates the developer collecting room 28T from the developer returning room 29T. The opening 31T is provided in the wall 30T. A developer is delivered from the receive-convey screw 35T to the slant-convey screw 38T through the opening 31T. The opening 31T has a substantial length along an axial direction of the receive-convey screw 35T or the slant-convey screw 38T. Thus, the developer is delivered from the developer collecting room 28T to the developer returning room 29T at an end of the receive-convey blade 37T or the slant-convey blade 40T in an axial direction of receive-convey blade 37T or the slant-convey blade 40T. The developer is also delivered at an end portion of the receive-convey blade 37T or the slant-convey blade 40T in the axial direction of receive-convey blade 37T or the slant-convey blade 40T. The end portion has the substantial length along the axial direction of the receive-convey screw 35T or the slant-convey screw 38T. At the end portion of the receive-convey blade 37T or the slant-convey blade 40T, the slant-convey screw 38T is located at a height level higher than the receive-convey screw 35T in a substantial area along the axial direction of the receive-convey screw 35T or the slant-convey screw 38T. Therefore, the developer is conveyed in a direction Q against gravity from the receive-convey screw 35T to the slant-convey screw 38T. The rotating receive-convey screw 35T pushes up the developer toward the rotating slant-convey screw 38T. However, the slant-convey blade 40T of the slant-convey screw 38T may not easily pick up the developer and may easily push back the developer toward the receive-convey screw 35T. Namely, the developer may not be properly conveyed from the receive-convey screw 35T to the slant-convey screw 38T. As a result, a developer collected from a developing sleeve (not shown) serving as a developer carrier may be accumulated on the receive-convey screw 35T. The accumulated developer may be transferred onto the developing sleeve, resulting in uneven developing density.

FIG. 8 is a sectional side view of the tester developing device 20T. As illustrated in FIG. 8, the wall 31T includes a lower inner wall 31Ta.

The opening 31T has a rectangular shape. The lower inner wall 31Ta extends in the axial direction of the receive-convey screw 35T. In the developer returning room 29T (depicted in FIG. 7) which is slanted, a height level of the lower inner wall 31Ta becomes lower relative to the slant-convey blade 40T (depicted in FIG. 7) toward the downstream end of the slant-convey screw 38T (depicted in FIG. 7) in the developer conveyance direction of the slant-convey screw 38T. In an area in which the opening 31T opposes the slant-convey screw 38T and near the upstream end of the slant-convey screw 38T in the developer conveyance direction of the slant-convey screw 38T, a portion of the wall 30T provided under the opening 31T covers a lower portion of the slant-convey blade 40T in a vertical direction, so that the slant-convey blade 40T holds the developer. Thus, the developer may not be sent back from the slant-convey screw 38T to the receive-convey screw 35T. However, in an area near the downstream end of the slant-convey screw 38T in the developer conveyance direction of the slant-convey screw 38T, a portion of the wall 30T provided under the opening 31T is too small to cover the slant-convey blade 40T. Thus, the rotating slant-convey screw 38T may push back the developer in a normal line direction onto the receive-convey screw 35T. Namely, the developer may not be properly delivered from the receive-convey screw 35T to the slant-convey screw 38T.

As illustrated in FIGS. 3 and 4, according to this non-limiting exemplary embodiment, a lower, outer circumferential end of the upstream end of the slant-convey blade 40M in the developer conveyance direction of the slant-convey blade 40M included in the slant-convey screw 38M is located at a height level lower than the lower, outer circumferential end of the downstream end of the receive-convey blade 37M in the developer conveyance direction of the receive-convey blade 37M included in the receive-convey screw 35M. Thus, according to one or more exemplary embodiments, the slant-convey screw 38M is located at a height level relatively higher or lower than the receive-convey screw 35M in an opposing area in which the receive-convey screw 35M opposes the slant-convey screw 38M via the opening 31M provided in the wall 30M. Therefore, the height difference is smaller than a height difference caused in the tester developing device 20T (depicted in FIG. 6) in which the lower, outer circumferential end of the upstream end of the slant-convey blade 40T (depicted in FIG. 6) in the developer conveyance direction of the slant-convey blade 40T is located at a height level common to the lower, outer circumferential end of the downstream end of the receive-convey blade 37T (depicted in FIG. 6) in the developer conveyance direction of the receive-convey blade 37T. As a result, a magenta developer may be smoothly delivered from the receive-convey screw 35M to the slant-convey screw 38M, and thereby the magenta developer may not be accumulated on the receive-convey screw 35M. The receive-convey screw 35M may reduce the magenta developer sent back to the developing sleeve 21Ms (depicted in FIG. 2) serving as a developer carrier, reducing uneven developing density.

An upstream end of the slant-convey shaft 39M in the developer conveyance direction of the slant-convey screw 38M is located at a height level lower than a downstream end of the receive-convey shaft 36M in the developer conveyance direction of the receive-convey screw 35M. The developing devices 20C, 20Y, and 20K (depicted in FIG. 1) have a structure common to the developing device 20M.

Figure 9:
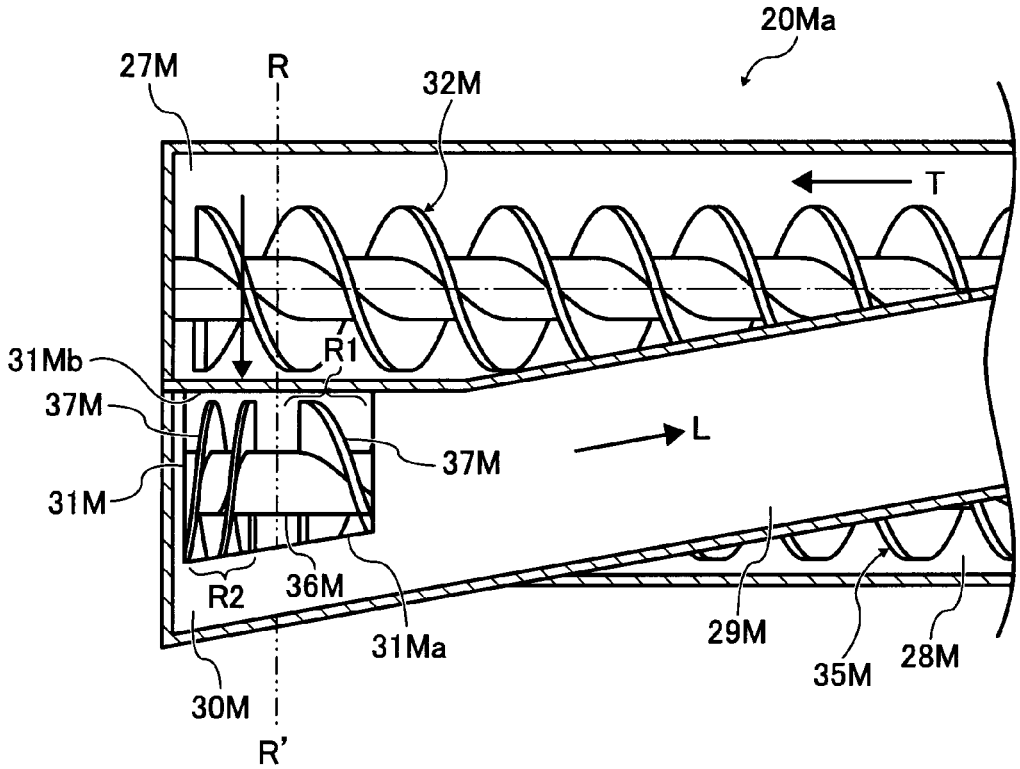
FIG. 9 is a sectional side view of a developing device according to another exemplary embodiment of the present invention.
Figure 10:
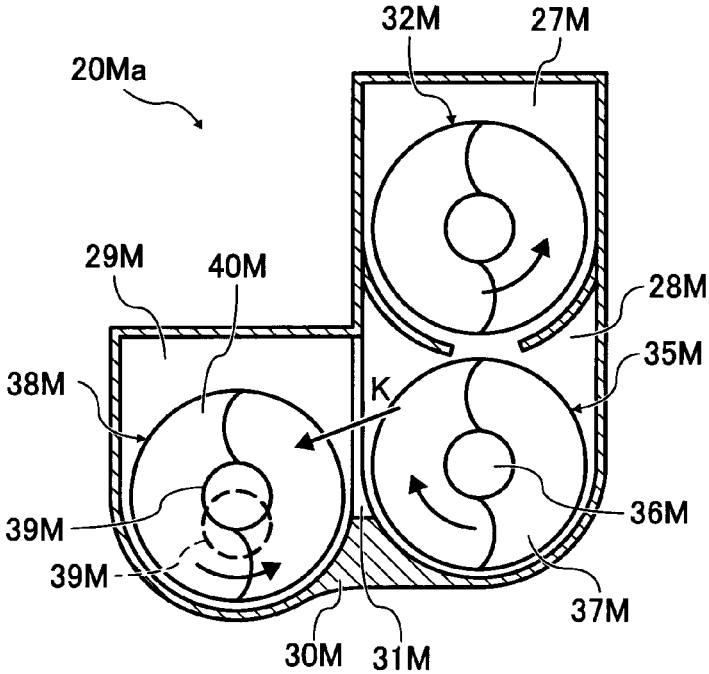
FIG. 10 is a sectional front view of a front portion of the developing device shown in FIG. 9.

Referring to FIGS. 9 and 10, the following describes an example developing device 20Ma according to this non-limiting exemplary embodiment. FIG. 9 is a sectional side view of the developing device 20Ma. In FIG. 9, the slant-convey screw 38M provided in the developer returning room 29M (depicted in FIG. 4) is omitted. The developing device 20Ma includes elements common to the developing device 20M (depicted in FIG. 4), but further includes a lower inner wall 31Ma and an upper inner wall 31Mb.

The lower inner wall 31Ma is provided at a bottom of the opening 31M. Unlike the lower inner wall 31Ta of the tester developing device 20T (depicted in FIG. 8) extending along the receive-convey shaft 36T included in the receive-convey screw 35T (depicted in FIG. 8), the lower inner wall 31Ma extends obliquely relative to the axial direction of the receive-convey screw 35M. Namely, the lower inner wall 31Ma extends in an axial direction of the slant-convey screw 38M (depicted in FIG. 4). In the developer returning room 29M extending obliquely relative to the horizontal direction, the lower inner wall 31Ma is located at a height level which is constant with respect to the slant-convey blade 40M (depicted in FIG. 4) in the developer conveyance direction of the slant-convey blade 40M. In an area in which the opening 31M opposes the slant-convey screw 38M, a portion of the wall 30M provided under the opening 31M covers a lower portion of the slant-convey blade 40M in a vertical direction, so that the slant-convey blade 40M holds a developer. Thus, the developer may not be sent back from the slant-convey screw 38M to the receive-convey screw 35M. Namely, the developer may be smoothly delivered from the receive-convey screw 35M to the slant-convey screw 38M.

In FIG. 9, a line R-R' represents a center line of the lower inner wall 31Ma in a direction L (i.e., a direction in which the lower inner wall 31Ma extends along the slant-convey screw 38M). At a position corresponding to the line R-R', the lower, outer circumferential end of the slant-convey blade 40M included in the slant-convey screw 38M is located at a height level lower than the lower, outer circumferential end of the receive-convey blade 37M included in the receive-convey screw 35M. Namely, in the area in which the opening 31M opposes the slant-convey screw 38M, the lower, outer circumferential end of the slant-convey blade 40M is located at a height level relatively lower than the lower, outer circumferential end of the receive-convey blade 37M. Thus, as illustrated in FIG. 10, a developer may be delivered in the direction K by gravity from the receive-convey screw 35M to the slant-convey screw 38M, resulting in a smooth delivery of the developer.

As illustrated in FIG. 9, the upper inner wall 31Mb is provided on a top of the wall 31M and extends in the horizontal direction. The upper inner wall 31Mb is located at a height level higher than an upper, outer circumferential end of the receive-convey blade 37M included in the receive-convey screw 35M in an area in which the receive-convey screw 35M opposes the opening 31M. Namely, the wall 30M is not provided in an area in which an upper portion of the receive-convey screw 35M in the vertical direction opposes the developer returning room 29M. Thus, when the rotating receive-convey screw 35M pushes a developer in the normal line direction from its upper portion toward the slant-convey screw 38M (depicted in FIG. 10), the wall 30M does not block the developer entering the developer returning room 29M. As a result, the developer may be smoothly delivered from the receive-convey screw 35M to the slant-convey screw 38M.

An opposing area, in which the receive-convey blade 37M opposes the opening 31M, includes a forward area R1 in which the receive-convey blade 37M is wound in a direction for conveying a developer in a forward direction (i.e., a direction T) and a backward area R2 in which the receive-convey blade 37M is wound in a direction for conveying a developer in a backward direction (i.e., substantially a direction L). The backward area R2 is provided downstream from the forward area R1 in the developer conveyance direction of the receive-convey screw 35M. In the opposing area, the developer is conveyed in opposite directions each other (i.e., the forward and backward directions) along a longitudinal direction of the receive-convey shaft 36M in the forward area R1 and the backward area R2, respectively. Thus, the developer conveyed in the opposite directions, respectively, pushes each other so that the developer is conveyed in the normal line direction with respect to the longitudinal direction of the receive-convey shaft 36M. The developer is prompted to move from the receive-convey screw 35M to the slant-convey screw 38M. As a result, the developer may be smoothly delivered from the receive-convey screw 35M to the slant-convey screw 38M.

As illustrated in FIG. 10, the slant-convey screw 38M conveys per unit time a developer in an amount greater than an amount conveyed per unit time by the receive-convey screw 35M. In the developer returning room 29M in which the slant-convey screw 38M conveys the developer upward against gravity, the slant-convey screw 38M conveys the developer sent from the developer collecting room 28M at a speed higher than a speed at which the receive-convey screw 35M sends the developer to the developer returning room 29M. Thus, the opposing area, in which the receive-convey blade 37M opposes the opening 31M, may not be clogged with the developer, preventing a faulty delivery of the developer from the developer collecting room 28M to the developer returning room 29M.

The slant-convey screw 38M may rotate faster than the receive-convey screw 35M so that the slant-convey screw 38M conveys a greater amount of developer than the receive-convey screw 35M. Alternatively, the slant-convey blade 40M included in the slant-convey screw 38M may have a greater pitch in the axial direction of the slant-convey screw 38M than the receive-convey blade 37M included in the receive-convey screw 35M. Otherwise, the slant-convey screw 38M including the slant-convey blade 40M having a greater pitch in the axial direction of the slant-convey screw 38M than the receive-convey blade 37M included in the receive-convey screw 35M may rotate faster than the receive-convey screw 35M.

Figure 11:
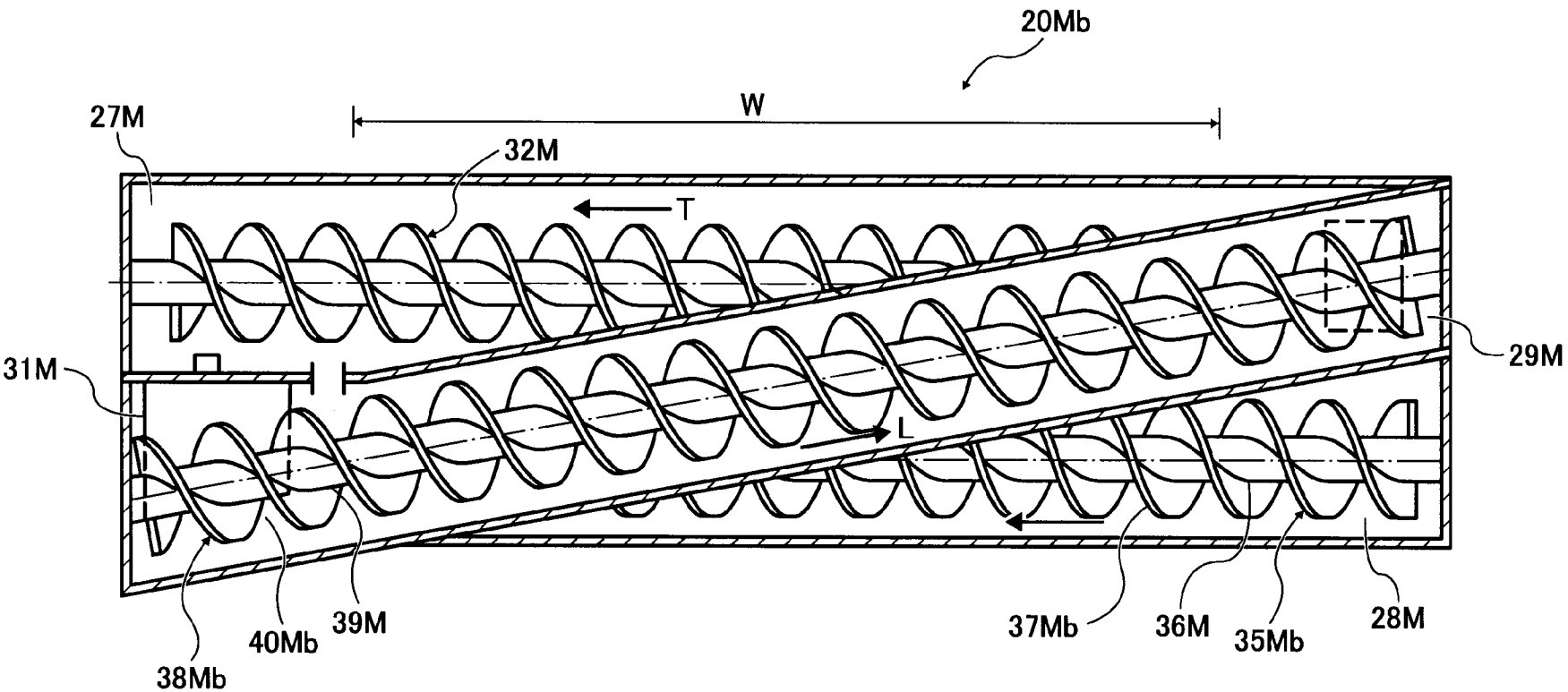
FIG. 11 is a sectional side view of a developing device according to yet another exemplary embodiment of the present invention.
Figure 12:
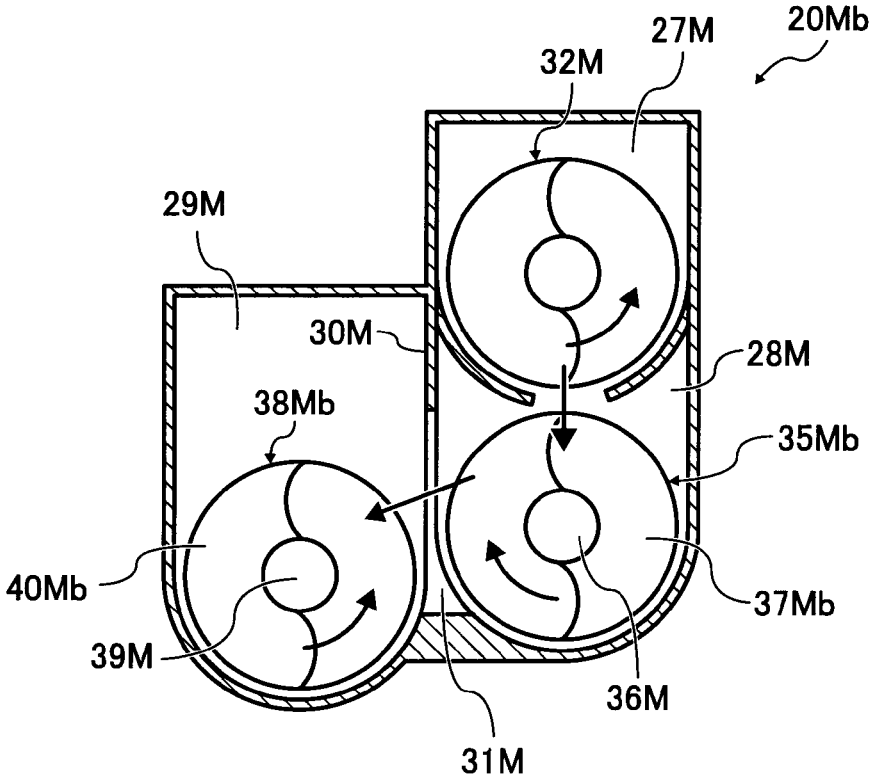
FIG. 12 is a sectional front view of a front portion of the developing device shown in FIG. 11.

Referring to FIGS. 11 and 12, the following describes another example developing device 20Mb according to this non-limiting exemplary embodiment of the invention. FIG. 11 is a sectional side view of the developing device 20Mb. FIG. 12 illustrates a cross section of the developing device 20Mb taken along a plane provided in one end in a longitudinal direction of the developing device 20Mb. The developing device 20Mb includes elements common to the developing device 20M (depicted in FIG. 4), but a receive-convey screw 35Mb, a slant-convey screw 38Mb, a receive-convey blade 37Mb, and a slant-convey blade 40Mb replace the receive-convey screw 35M, the slant-convey screw 38M, the receive-convey blade 37M, and the slant-convey blade 40M (depicted in FIG. 4), respectively.

An outside diameter of the slant-convey blade 40Mb is greater than an outside diameter of the receive-convey blade 37Mb. Namely, an outside diameter of the slant-convey screw 38Mb is greater than an outside diameter of the receive-convey screw 35Mb. Even when a relative position between the receive-convey shaft 36M and the slant-convey shaft 39M and a length of the receive-convey shaft 36M and the slant-convey shaft 39M are not changed, the receive-convey blade 37Mb and the slant-convey blade 40Mb having the outside diameters different from each other cause the lower, outer circumferential end of the upstream end of the slant-convey blade 40Mb in a developer conveyance direction of the slant-convey screw 40Mb to be located at a height level lower than the lower, outer circumferential end of the downstream end of the receive-convey blade 37Mb in a developer conveyance direction of the receive-convey blade 37Mb. The outside diameter of the slant-convey screw 38Mb may be greater than the outside diameter of the receive-convey screw 35Mb constantly in axial directions of the slant-convey screw 38Mb and the receive-convey screw 35Mb. Alternatively, the outside diameter of the slant-convey screw 38Mb may be greater than the outside diameter of the receive-convey screw 35Mb at least in the opposing area in which the receive-convey screw 35Mb opposes the opening 31M.

The slant-convey screw 38Mb and the receive-convey screw 35Mb include the slant-convey blade 40Mb and the receive-convey blade 37Mb having outside diameters different from each other, respectively. However, the slant-convey shaft 39M and the receive-convey shaft 36M have a common diameter and the slant-convey blade 40Mb and the receive-convey blade 37Mb have a common pitch. The slant-convey screw 38Mb carries per unit length a developer in an amount greater than an amount carried per unit length by the receive-convey screw 35Mb. Thus, even when the slant-convey screw 38Mb and the receive-convey screw 35Mb rotate at a common speed, the slant-convey screw 38Mb may convey per unit time a developer in an amount greater than an amount conveyed per unit time by the receive-convey screw 35Mb.

Figure 13:
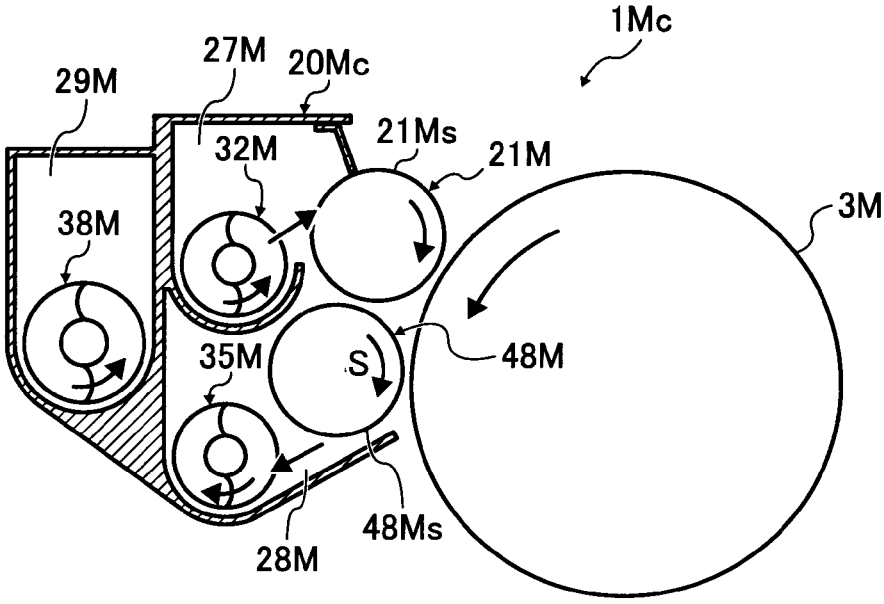
FIG. 13 is a sectional view of an image forming device according to yet another exemplary embodiment of the present invention.
Figure 14:
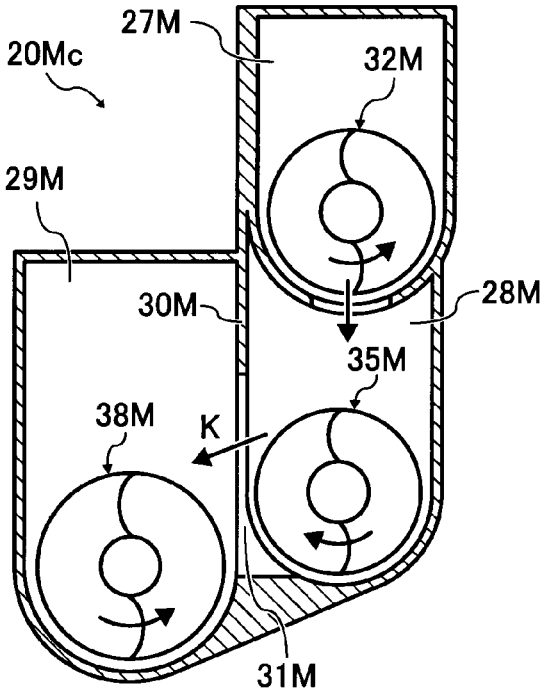
FIG. 14 is a sectional front view of a front portion of a developing device included in the image forming device shown in FIG. 13.
Figure 15:
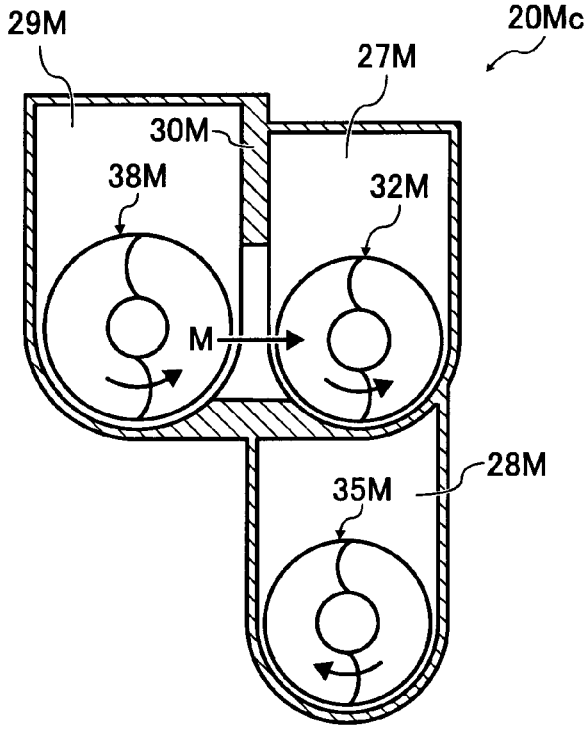
FIG. 15 is a sectional front view of a rear portion of the developing device shown in FIG. 14.

Referring to FIGS. 13 to 15, the following describes an image forming device 1Mc according to another exemplary embodiment of the present invention. FIG. 13 is a sectional view of the image forming device 1Mc. FIG. 14 illustrates a cross section of a developing device 20Mc included in the image forming device 1Mc taken along a plane provided in one end in a longitudinal direction of the developing device 20Mc. FIG. 15 illustrates a cross section of the developing device 20Mc taken along a plane provided in another end in the longitudinal direction of the developing device 20Mc. The image forming device 1Mc includes elements common to the image forming device 1SM (depicted in FIG. 2), but the developing device 20Mc replaces the developing device 20M. In addition to the elements included in the developing device 20M, the developing device 20Mc further includes a second developing roller 48M. The second developing roller 48M includes a second developing sleeve 48Ms.

As illustrated in FIG. 13, the second developing roller 48M is disposed under the developing roller 21M. The developing roller 21M picks up a developer supplied by the supply-convey screw 32M and applies the developer onto an electrostatic latent image formed on the photoconductor 3M. Like the developing roller 21M, the second developing roller 48M includes the second developing sleeve 48Ms and a magnetic roller (not shown). The second developing sleeve 48Ms serves as a developer carrier for carrying a developer and rotates in a rotating direction S. The magnetic roller is provided inside the second developing sleeve 48Ms.

As illustrated in FIG. 13, when the rotating developing sleeve 21Ms conveys a developer to a first developing position at which the developing sleeve 21Ms opposes the photoconductor 3M, an electrostatic latent image formed on the photoconductor 3M is developed with the developer at the first developing position. The rotating developing sleeve 21Ms further conveys the developer to an opposing position at which the developing sleeve 21Ms opposes the second developing sleeve 48Ms. At the opposing position, the developer moves from the developing sleeve 21Ms to the second developing sleeve 48Ms. The rotating second developing sleeve 48Ms conveys the developer to a second developing position at which the second developing sleeve 48Ms opposes the photoconductor 3M. At the second developing position, an electrostatic latent image formed on the photoconductor 3M is developed with the developer. The rotating second developing sleeve 48Ms further conveys the developer to an opposing position at which the second developing sleeve 48Ms opposes the receive-convey screw 35M provided in the developer collecting room 28M. At the opposing position, the receive-convey screw 35M collects the developer.

As illustrated in FIGS. 14 and 15, the developing device 20Mc includes the developer supplying room 27M, the developer collecting room 28M, the developer returning room 29M, the supply-convey screw 32M, the receive-convey screw 35M, the slant-convey screw 38M, the wall 30M, and the opening 31M, which are similar to the developing device 20M depicted in FIGS. 3 to 5. As illustrated in FIG. 14, the developer collected by the receive-convey screw 35M is delivered in the direction K from the receive-convey screw 35M to the slant-convey screw 38M. As illustrated in FIG. 15, the developer is delivered in the direction M from the slant-convey screw 38M to the supply-convey screw 32M.

The above exemplary embodiments describes the developing device 20M depicted in FIGS. 3 to 5, the developing device 20Ma depicted in FIGS. 9 and 10, the developing device 20Mb depicted in FIGS. 11 and 12, and the developing device 20Mc depicted in FIGS. 13 to 15 installed in the image forming apparatus 100 (depicted in FIG. 1), that is, a tandem type image forming apparatus including a plurality of image forming devices.

In the tandem type image forming apparatus, the plurality of image forming devices form toner images in colors different from each other. The toner images are transferred and superimposed on a sheet to form a color toner image. However, the above-described non-limiting exemplary embodiments may be applied to a single type image forming apparatus including a single image forming device. In the single type image forming apparatus, a plurality of developing devices using toners in colors different from each other are provided around a single latent image carrier (e.g., a photoconductor). The developing devices used for developing electrostatic latent images for corresponding colors formed on the latent image carrier are switched to sequentially visualize the electrostatic latent images, respectively. The visualized images are sequentially transferred and superimposed onto an intermediate transfer member. The above-described non-limiting exemplary embodiments may also be applied to an image forming apparatus for forming a monochrome toner image.

As illustrated in FIG. 9, in the developing device 20Ma, the lower inner wall 31Ma of the opening 31M extends obliquely relative to the axial direction of the receive-convey screw 35M along the axial direction of the slant-convey screw 38M (depicted in FIG. 10). Thus, a developer may not be sent back from the slant-convey screw 38M to the receive-convey screw 35M. Namely, the developer may be smoothly delivered from the receive-convey screw 35M to the slant-convey screw 38M.

As illustrated in FIG. 9, the line R-R' represents the center line of the lower inner wall 31Ma in the direction in which the lower inner wall 31Ma extends along the developer conveyance direction of the slant-convey screw 38M (depicted in FIG. 10). As illustrated in FIG. 10, at the position corresponding to the line R-R', the lower, outer circumferential end of the slant-convey blade 40M included in the slant-convey screw 38M is located at a height level lower than the lower, outer circumferential end of the receive-convey blade 37M included in the receive-convey screw 35M. Thus, a developer may be delivered by gravity from the receive-convey screw 35M to the slant-convey screw 38M, resulting in a smooth delivery of the developer.

As illustrated in FIGS. 11 and 12, in the developing device 20Mb, the outside diameter of the slant-convey screw 38Mb is greater than the outside diameter of the receive-convey screw 35Mb at least in the opposing area in which the slant-convey screw 38Mb opposes the opening 31M. Thus, even when the relative position between the receive-convey shaft 36M and the slant-convey shaft 39M and the length of the receive-convey shaft 36M and the slant-convey shaft 39M are not changed, the lower, outer circumferential end of the upstream end of the slant-convey blade 40Mb in the developer conveyance direction of the slant-convey blade 40Mb may be located at a height level lower than the lower, outer circumferential end of the downstream end of the receive-convey blade 37Mb in the developer conveyance direction of the receive-convey blade 37Mb.

As illustrated in FIG. 9, in the developing device 20Ma, the upper inner wall 31Mb is located at a height level higher than the upper, outer circumferential end of the receive-convey blade 37M included in the receive-convey screw 35M in the area in which the receive-convey screw 35M opposes the opening 31M. Thus, when the rotating receive-convey screw 35M pushes a developer in the normal line direction from its upper portion toward the slant-convey screw 38M (depicted in FIG. 10), the wall 30M does not block the developer entering the developer returning room 29M. As a result, the developer may be smoothly delivered from the receive-convey screw 35M to the slant-convey screw 38M.

As illustrated in FIG. 9, in the developing device 20Ma, the opposing area, in which the receive-convey blade 37M opposes the opening 31M, includes the forward area R1 in which the receive-convey blade 37M is wound in the direction for conveying a developer in the forward direction (i.e., the direction T) and the backward area R2 in which the receive-convey blade 37M is wound in the direction for conveying a developer in the backward direction (i.e., substantially the direction L). The backward area R2 is provided downstream from the forward area R1 in the developer conveyance direction of the receive-convey screw 35M. Thus, the developer is prompted to move from the receive-convey screw 35M to the slant-convey screw 38M (depicted in FIG. 10). As a result, the developer may be smoothly delivered from the receive-convey screw 35M to the slant-convey screw 38M.

As illustrated in FIG. 10, in the developing device 20Ma, the slant-convey screw 38M conveys per unit time a developer in an amount greater than an amount conveyed per unit time by the receive-convey screw 35M. Thus, the opposing area, in which the receive-convey blade 37M opposes the opening 31M, may not be clogged with the developer, preventing a faulty delivery of the developer from the developer collecting room 28M to the developer returning room 29M.

The developing device (i.e., the developing device 20M depicted in FIG. 3, the developing device 20Ma depicted in FIG. 10, the developing device 20Mb depicted in FIG. 12, and the developing device 20Mc depicted in FIG. 14) includes an opposing area in which the receive-convey screw (i.e., the receive-convey screw 35M depicted in FIGS. 3, 10, and 14, and the receive-convey screw 35Mb depicted in FIG. 12)

opposes the slant-convey screw (i.e., the slant-convey screw 38M depicted in FIGS. 3, 10, and 14, and the slant-convey screw 38Mb depicted in FIG. 12) via the opening (i.e., the opening 31M depicted in FIGS. 3, 10, 12, and 14) provided in the wall (i.e., the wall 30M depicted in FIGS. 3, 10, 12, and 14). Even when the slant-convey screw is located at a height level relatively higher or lower than the receive-convey screw in the opposing area, the height difference is smaller than a height difference caused in the developing device (i.e., the tester developing device 20T depicted in FIG. 6) in which the lower, outer circumferential end of the upstream end of the blade (i.e., the slant-convey blade 40T depicted in FIG. 6) in the developer conveyance direction of the blade is located at a height level common to the lower, outer circumferential end of the downstream end of another blade (i.e., the receive-convey blade 37T depicted in FIG. 6) in the developer conveyance direction of the another blade. As a result, a developer may be smoothly delivered from the receive-convey screw to the slant-convey screw, and thereby the developer may not be accumulated on the receive-convey screw. The receive-convey screw may reduce the developer sent back to the developer carrier (i.e., the developing sleeve 21Ms depicted in FIG. 2 and the developing sleeve 48Ms depicted in FIG. 13), reducing uneven developing density.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

a latent image carrier configured to carry a latent image; and a developing device configured to develop the latent image carried by the latent image carrier with a developer containing toner particles and carriers, the developing device including:

a developer carrier configured to carry the developer, a receive-convey screw configured to receive the developer from the developer carrier and to convey the developer in an axial direction of the receive-convey screw, the receive-convey screw including:

a receive-convey blade including a lower, outer circumferential end located in a downstream end of the receive-convey blade in the developer conveyance direction of the receive-convey screw, and a slant-convey screw disposed obliquely relative to the axial direction of the receive-convey screw, and configured to receive the developer from the receive-convey screw and to convey the developer upward in an axial direction of the slant-convey screw, the slant-convey screw including:

a slant-convey blade including a lower, outer circumferential end located in an upstream end of the slant-convey blade in the developer conveyance direction of the slant-convey screw, the lower, outer circumferential end being located at a height level lower than the lower, outer circumferential end of the receive-convey blade, wherein the developing device further includes a wall having a bottom surface and a top surface provided between the receive-convey screw and the slant-convey screw, the wall including an opening having an upper inner wall and a lower inner wall, the lower inner wall spaced apart from the bottom surface of the wall, the opening opposing the downstream end of the receive-convey blade in the developer conveyance direction of the receive-convey screw, the receive-convey screw transfers the developer to the slant-convey screw via the opening, wherein the lower, outer circumferential end of the slant-convey blade is located at a height level lower than the lower, outer circumferential end of the receive-convey blade at a center line of the lower inner wall in a direction in which the lower inner wall extends, and wherein the lower inner wall of the opening is disposed obliquely relative to the upper inner wall of the opening in an axial direction of the slant-convey screw, and wherein a spaced apart region of the wall between the bottom surface of the wall and the lower inner wall of the opening covers a lower portion of the slant-convey blade.

2. The image forming apparatus according to claim 1, wherein the developing device further includes a supply-convey screw configured to receive the developer from the slant-convey screw and to convey the developer in an axial direction of the supply-convey screw so as to supply the developer to the developer carrier.

3. The image forming apparatus according to claim 1, wherein the receive-convey screw further includes a receive-convey shaft configured to support the receive-convey blade provided on an outer circumferential surface of the receive-convey shaft in a manner that the receive-convey blade has a spiral shape, and wherein the slant-convey screw further includes a slant-convey shaft configured to support the slant-convey blade provided on an outer circumferential surface of the slant-convey shaft in a manner that the slant-convey blade has a spiral shape.

4. The image forming apparatus according to claim 3, wherein an upstream end of the slant-convey shaft in the developer conveyance direction of the slant-convey screw is located at a height level lower than a downstream end of the receive-convey shaft in the developer conveyance direction of the receive-convey screw.

5. The image forming apparatus according to claim 1, wherein an outside diameter of the slant-convey blade is greater than an outside diameter of the receive-convey blade at least in an area in which the slant-convey screw opposes the opening.

6. The image forming apparatus according to claim 1, wherein the opening includes an upper inner wall located at a height level higher than an upper, outer circumferential end of the receive-convey blade in an area in which the receive-convey screw opposes the opening.

7. The image forming apparatus according to claim 1, wherein an opposing area, in which the receive-convey blade opposes the opening, includes a forward area in which the receive-convey blade is wound in a direction for conveying the developer in a forward direction and a backward area in which the receive-convey blade is wound in a direction for conveying the developer in a backward direction opposite to the forward direction, and wherein the backward area is provided downstream from the forward area in the developer conveyance direction of the receive-convey screw.

8. The image forming apparatus according to claim 1, wherein the slant-convey screw conveys per unit time the developer in an amount greater than an amount conveyed per unit time by the receive-convey screw.

9. The image forming apparatus according to claim 1, wherein an outside diameter of the slant-convey blade is greater than an outside diameter of the receive-convey blade along at least a portion of a length of the slant-convey blade.

10. A developing device for developing a latent image carried by a latent image carrier with a developer containing toner particles and carriers, the developing device comprising:

a developer carrier configured to carry the developer;

a receive-convey screw configured to receive the developer from the developer carrier and to convey the developer in an axial direction of the receive-convey screw, the receive-convey screw including:

a receive-convey blade including a lower, outer circumferential end located in a downstream end of the receive-convey blade in the developer conveyance direction of the receive-convey screw;

a slant-convey screw disposed obliquely relative to the axial direction of the receive-convey screw, and configured to receive the developer from the receive-convey screw and to convey the developer upward in an axial direction of the slant-convey screw, the slant-convey screw including:

a slant-convey blade including a lower, outer circumferential end located in an upstream end of the slant-convey blade in the developer conveyance direction of the slant-convey screw, the lower, outer circumferential end being located at a height level lower than the lower, outer circumferential end of the receive-convey blade; and a wall having a bottom surface and a top surface provided between the receive-convey screw and the slant-convey screw, the wall including an opening having an upper inner wall and a lower inner wall, the lower inner wall spaced apart from the bottom surface of the wall, the opening opposing the downstream end of the receive-convey blade in the developer conveyance direction of the receive-convey screw, wherein the receive-convey screw transfers the developer to the slant-convey screw via the opening and wherein the lower, outer circumferential end of the slant-convey blade is located at a height level lower than the lower, outer circumferential end of the receive-convey blade at a center line of the lower inner wall in a direction in which the lower inner wall extends, and wherein the lower inner wall of the opening is disposed obliquely relative to the upper inner wall of the opening in an axial direction of the slant-convey screw, and wherein a spaced apart region of the wall between the bottom surface of the wall and the lower inner wall of the opening covers a lower portion of the slant-convey blade.

11. The developing device according to claim 10, further comprising:

a supply-convey screw configured to receive the developer from the slant-convey screw and to convey the developer in an axial direction of the supply-convey screw so as to supply the developer to the developer carrier.

12. The developing device according to claim 10, wherein the receive-convey screw further includes a receive-convey shaft configured to support the receive-convey blade provided on an outer circumferential surface of the receive-convey shaft in a manner that the receive-convey blade has a spiral shape, and wherein the slant-convey screw further includes a slant-convey shaft configured to support the slant-convey blade provided on an outer circumferential surface of the slant-convey shaft in a manner that the slant-convey blade has a spiral shape.

13. The developing device according to claim 12, wherein an upstream end of the slant-convey shaft in the developer conveyance direction of the slant-convey screw is located at a height level lower than a downstream end of the receive-convey shaft in the developer conveyance direction of the receive-convey screw.

14. The developing device according to claim 10, wherein an outside diameter of the slant-convey blade is greater than an outside diameter of the receive-convey blade at least in an area in which the slant-convey screw opposes the opening.

15. The developing device according to claim 10, wherein the opening includes an upper inner wall located at a height level higher than an upper, outer circumferential end of the receive-convey blade in an area in which the receive-convey screw opposes the opening.

16. The developing device according to claim 10, wherein an outside diameter of the slant-convey blade is greater than an outside diameter of the receive-convey blade along at least a portion of a length of the slant-convey blade.

* * * * *